US010244823B2

(12) United States Patent
Boag

(10) Patent No.: US 10,244,823 B2
(45) Date of Patent: Apr. 2, 2019

(54) SHOE HEEL CUP PROTECTION DEVICE

(71) Applicant: MODEL BEHAVIOUR (AUST) PTY LTD., Jan Juc, Victoria (AU)

(72) Inventor: Andrew Boag, Jan Juc (AU)

(73) Assignee: Model Behaviour (Aust) Pty Ltd., Jan Juc, Victoria (AU)

( * ) Notice: Subject to any disclaimer, the term of this patent is extended or adjusted under 35 U.S.C. 154(b) by 10 days.

(21) Appl. No.: 15/028,367

(22) PCT Filed: Oct. 27, 2013

(86) PCT No.: PCT/IB2013/059688
§ 371 (c)(1),
(2) Date: Apr. 8, 2016

(87) PCT Pub. No.: WO2015/059527
PCT Pub. Date: Apr. 30, 2015

(65) Prior Publication Data

US 2016/0249708 A1 Sep. 1, 2016

(51) Int. Cl.
*A43C 13/00* (2006.01)
*A43C 15/04* (2006.01)
(Continued)

(52) U.S. Cl.
CPC ..... *A43C 13/00* (2013.01); *A43B 3/16* (2013.01); *A43B 21/22* (2013.01); *A43C 15/04* (2013.01)

(58) Field of Classification Search
CPC ..... A43C 13/00; A43C 15/04; A43B 3/16; A43B 21/22
(Continued)

(56) References Cited

U.S. PATENT DOCUMENTS 2,489,018 A * 11/1949 Dodge ..... A43B 3/16 36/1
2,875,534 A * 3/1959 Grossman ..... A43B 3/166 36/72 B
(Continued)

FOREIGN PATENT DOCUMENTS

GB 726390 3/1955
GB 842426 7/1960
(Continued)

*Primary Examiner* — Richale Quinn
*Assistant Examiner* — Anne Kozak
(74) *Attorney, Agent, or Firm* — Muncy, Geissler, Olds & Lowe, P.C.

(57) ABSTRACT

A shoe heel cup device including a ground contacting base portion and a resilient shoe heel engagement portion forming a unitary member, the resilient shoe heel engagement portion being a cup containing, but not limited to, at least live flexible equispaced projecting ribs within the inner surface together defining a bore for receiving a shoe heel therein, the entry of which is smaller in diameter to the base.

The invention has been described in language more or less specific to the device features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

11 Claims, 3 Drawing Sheets

(51) Int. Cl.
*A43B 3/16* (2006.01)
*A43B 21/22* (2006.01)

(58) Field of Classification Search
USPC ..... 36/72
See application file for complete search history.

(56) References Cited

U.S. PATENT DOCUMENTS 2,977,691 A * 4/1961 Brown ..... A43B 3/16 36/7.1 A
2,997,795 A * 8/1961 Bingham, Jr. ..... A43B 3/16 36/7.1 A
3,045,365 A * 7/1962 Bingham, Jr. ..... A43B 3/16 36/7.1 A
3,077,679 A * 2/1963 Hanko ..... A43B 3/16 36/7.1 A
3,122,848 A * 3/1964 Grossman ..... A43B 3/166 36/7.1 A
3,195,245 A * 7/1965 Hanko ..... A43B 3/16 36/7.3
3,439,435 A * 4/1969 Fredon ..... A43B 3/166 367/72 B
4,785,556 A * 11/1988 Blair ..... A43B 3/16 36/7.1 R
7,971,373 B2 * 7/2011 Epping ..... A43B 3/0078 36/42
8,033,035 B2 * 10/2011 Brown ..... A43B 3/166 36/36 R
8,141,275 B1 * 3/2012 Donaldson ..... A43B 21/22 36/72 B
2008/0148606 A1 * 6/2008 Brown ..... A43C 13/00 36/72 B
2009/0165337 A1 * 7/2009 Cohen ..... A43B 21/22 36/136
2011/0030246 A1 * 2/2011 Muller ..... A43B 21/42 36/72 B
2011/0185601 A1 * 8/2011 Hampton ..... A43B 23/00 36/72 B
2011/0314704 A1 * 12/2011 Naismith-Beeley ..... A43B 1/0018 36/34 R
2014/0033579 A1 * 2/2014 Greener ..... A43B 23/00 36/72 B
2014/0075789 A1 * 3/2014 Perry ..... A43B 3/166 36/72 B
2014/0250736 A1 * 9/2014 Zadeh ..... A43B 21/22 36/72 B
2014/0259803 A1 * 9/2014 Reardon ..... A43B 21/42 36/34 B
2016/0051002 A1 * 2/2016 Thompson ..... A43B 1/0072 12/142 K

FOREIGN PATENT DOCUMENTS

WO WO 2010/012047 A1 2/2010
WO WO 2014/137410 A1 9/2014

* cited by examiner

SHOE HEEL CUP PROTECTION DEVICE

FIELD OF THE INVENTION

The present invention relates to a device for a shoe heel to prevent or inhibit the heel from sinking into a soft surface when a shoe is being worn.

BACKGROUND ART

Devices similar to that of the present invention are available. One such device is described in international Patent to Publication No. WO 2007/124534 which also contains a useful description of the prior art to date. A section of the "background of the invention" portion of that document follows verbatim:

"It is well known that there is a large number of different types of footwear, including shoes that cater for different functions and fashions. Women's shoes in particular, are often equipped with a raised or high heel. In many instances, the design of the heel is such that the heel is relatively narrow in width, with the heel essentially consisting of an elongate stem. An example of this is the known stiletto heel. However, there are many other different types of heel designs that generally consist of a stemmed shape or configuration. A problem that may be encountered by a person wearing shoes with such a heel is that the heel may sink into the ground that is being walked upon. This is a particular problem when the ground is soft, such as sand or grass. In these instances, it can become difficult for the person to walk upon such a surface, as the heel must often be pulled out of the ground with each step. A similar problem can be encountered when the ground is relatively unstable, such as when walking on a gravel road or path. In such an event, the narrow stem structure of the heel can sink in between rocks or pebbles that make up the ground. This may lead to general instability for the person walking thereon, thereby increasing the possibility of injury by, for example, falling and spraining or twisting an ankle. In addition, in such circumstances, there is also the capacity for causing damage to the shoe, in particular the heel. The likelihood of damage to the shoe is greater for those shoes that are manufactured from delicate materials, such as suede or fine fabrics. Unfortunately, it is often the case that such shoes are most often the most expensive to buy and their subsequent repair or replacement may come at significant expense to their owner. Similar safety and shoe maintenance problems can also be encountered when high heeled shoes are worn whilst walking upon a surface that has numerous or significant gaps, for example, upon planks of a decking surface. The present invention attempts to overcome at least in part the aforementioned disadvantages and problems that may be encountered whilst wearing raised or high heeled shoes, particularly whilst standing or walking upon surfaces that are soft, unstable or generally uneven."

The above tract of discussion highlights the issues faced by a device of the general kind of that of the present invention.

It will be clearly understood that, if a prior art publication is referred to herein, this reference does not constitute an admission that the publication forms any part of the common general knowledge in the art in Australia or in any other country.

SUMMARY OF THE INVENTION

In a first aspect, the present invention provides a unitary shoe heel accessory. The unitary shoe heel accessory comprises a base portion comprising a ground contacting surface and an opposing heel contacting surface, and a resilient shoe heel engaging portion which extends from the heel contacting surface and defines a cup having side walls comprising a plurality of equispaced resilient ribs projecting therefrom, with the resilient ribs defining therebetween a bore for receiving and retaining a shoe heel. The heel contacting surface comprises a plurality of trenches from which the resilient ribs emerge.

In some embodiments, a lower edge of each resilient rib may be affixed to a floor of each trench. The depth of each trench may, in some embodiments, be such that a lowermost shoe heel contacting portion of each resilient rib is deflectable by a shoe heel.

In some embodiments, the width of each trench may be such that the deflectability of a lowermost shoe heel contacting portion of the resilient rib is limited.

In some embodiments, each resilient rib may extend from the trench to an uppermost edge of the resilient shoe heel engaging portion.

In some embodiments, each resilient rib may taper inwardly towards the other resilient ribs as it extends away from the trench.

In some embodiments, an uppermost edge of each resilient rib may be curved to define a shoe heel entry guide.

In some embodiments, an outer surface of the resilient shoe heel engaging portion may taper outwardly from its upper edge to the base portion.

In some embodiments, the base portion may be configured to provide a ground contacting surface which increases in size as the shoe heel protector abuts relatively softer ground.

In some embodiments, the base portion may taper outwardly from the ground contacting surface to the side walls of the shoe heel engaging portion.

In some embodiments, the unitary shoe heel accessory may further comprise a cushion portion located on the heel contacting surface at the base of the bore.

In some embodiments, the base portion may be substantially circular. In some embodiments, the unitary shoe heel accessory may comprise five equispaced resilient ribs.

In a second aspect, the present invention provides a shoe heel cup device including a ground contacting base portion and a resilient shoe heel engagement portion forming a unitary member. The resilient shoe heel engagement portion is a cup containing a number of flexible equispaced projecting ribs within an inner surface, the equispaced projecting ribs together defining a bore for receiving a shoe heel therein. An internal base of the device has a number of furrows or trenches equal to the number of projecting ribs from which the equispaced projecting ribs emerge.

Disclosed herein is a shoe heel cup device/accessory including in a unitary form, a ground contacting base portion and a resilient shoe heel engagement portion, the resilient shoe heel engagement portion being a cup containing a number of flexible equispaced projecting ribs within the inner surface together defining a bore for receiving a shoe heel therein.

The device has been designed to provide the stability and support required by a high heel shoe with an elongated stem, such as a Stiletto Heel when walking in the soft ground (sand and dirt). The device will prevent a high heel shoe from sinking in soft ground (avoiding any potential injury and providing protection to expensive high heel shoes) as well as functioning to protect hardwood floors from high heel stiletto type shoes making indentations in the timber.

The ground contacting base portion is larger in cross-sectional dimension than the heel in order to spread the load and to support the heel from penetrating the ground surface.

The base portion is configured as a planar member with one circumferential upright extension. This extension is in the form of a cup with internal fins or ribs shaped to engage with a shoe heel. The projecting ribs are arrayed in a circular configuration equispaced about the bore of the device and extend upwardly from the base of the device to the top of the device into, but not through, the heel engagement portion.

The internal base of the device has a number of furrows or trenches equal to the number of projecting ribs from which the ribs emerge to enable projecting ribs to be altered by a shoe heel from base to tip without compromise to the internal base portion of the device upon which the heel pad rests.

The base portion and heel engagement portion of the device is manufactured in a single unitary manner in rigid plastic or similar forming a device of one continuous part.

The heel engagement portion is a unitary member with a number of features. The external appearance of which represents an inverted cup member.

The heel engagement portion is manufactured from a resilient material the configuration of which will preferably be biased inwardly to grip the heel once the heel is inserted into the bore.

The heel engagement portion includes a number of projecting ribs extending from the furrows in the base to the top of the device placed about the internal surface of the cup in an equispaced arrangement, the entry of which is smaller in diameter to the base.

The projecting ribs may extend substantially from the top of the device to the furrows within the ground-contacting portion of the device, with the rib projection at the entry of the bore being greater than the rib projection within the furrows at the base of the device. Adjusting the projection of the ribs will typically adjust the degree of heel engagement and thereby increase surface friction with a shoe heel and reduce the relative size of the bore.

According to this embodiment, the unitary shoe heel cup device will be manufactured from a resilient plastic, typically one that has a clear appearance. The plastic may be coloured or otherwise adapted with either an integral or surface finish in order to render the device aesthetically pleasing. According to the most preferred embodiment, the device will resemble an inverse cup when viewed from above. The device may have a gemstone faceted treatment or any other aesthetic modification to the exterior surface of the device extending from the base to the top of the device.

In this way, as the heel of the shoe is inserted into the shoe heel cup, the projecting ribs, regardless of number, are deformed outwardly in order to allow passage of the heel, and also grip the heel once inserted.

If necessary, projecting ribs may be increased in number or made more rigid or stiff by increasing their projection and thickness to provide sufficient stiffness or resistance against the resilient deformation. This may be used in situations where it is found that the device does not engage with the shoe heel securely enough, causing it to come loose.

The cup device itself is circular in appearance, but it may be shaped differently as shoe heels are typically D-shaped in cross section. Therefore the cup may be D-shaped as well.

Depending on the preferred embodiment, the shoe heel cup may have a continuous sidewall extending from the upper portion of the device to a region adjacent to the ground-contacting portion.

The shoe heel cup will have a larger dimension in a region adjacent to the ground contacting portion and a smaller dimension at an upper region. In this manner, the upper region acts to grip the shoe heel whilst the larger dimension lower down allows clearance for the heel pad of the shoe.

Preferably, the device of the preferred embodiment will be configured to provide a gradual increase in the surface area of the device as the device abuts relatively soft ground.

According to another embodiment, the invention resides in a shoe having a heel with a shoe heel cup device including a ground contacting base and a resilient shoe heel engagement system, the resilient shoe heel engagement portion including, but not limited to, five projecting ribs defining a bore for receiving a shoe heel therein, the deformation of the projecting ribs allowing passage of the shoe heel, and also grip of the shoe heel once inserted.

The device of the present invention is sized for a combination of aesthetics, and to not interfere with walking (snowshoe/flipper effect) but still being large enough to function by inhibiting penetration of the heel of the shoe into relatively soft ground.

Also by using the inwardly projecting ribs deformed about the shoe heel, the device relies on friction to adhere to the heel, maximising performance of the product in relatively soft ground.

BRIEF DESCRIPTIONS OF THE DRAWINGS

Various embodiments of the invention will be described with reference to the following drawing, in which.

DETAILED DESCRIPTION OF THE PREFERRED EMBODIMENT

Figure 1:
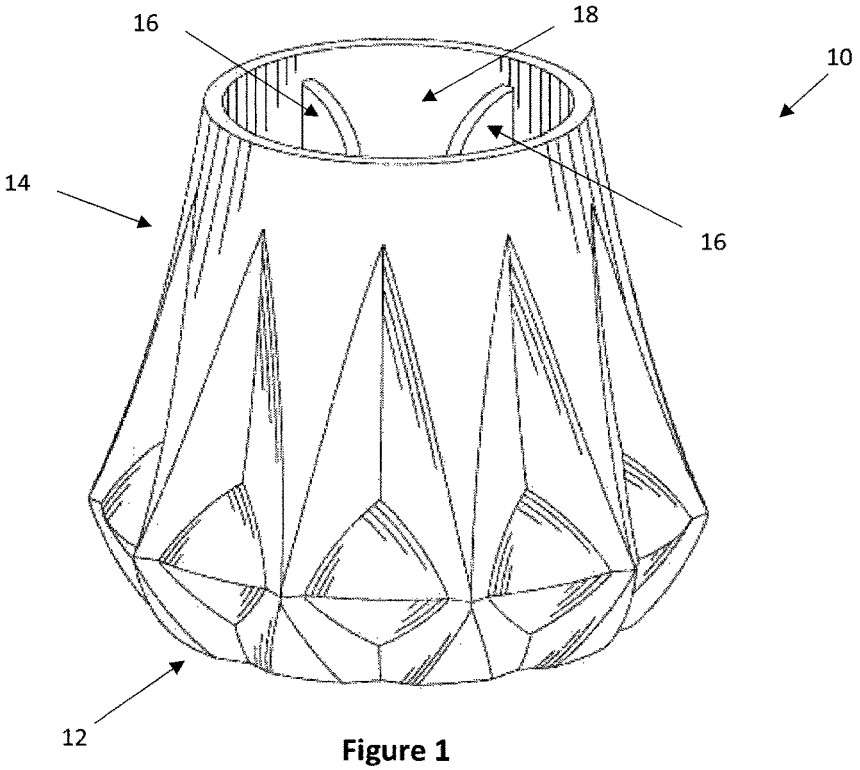
FIG. 1 is a perspective view from above of a shoe heel cup device according to a preferred embodiment of the present invention.
Figure 2:
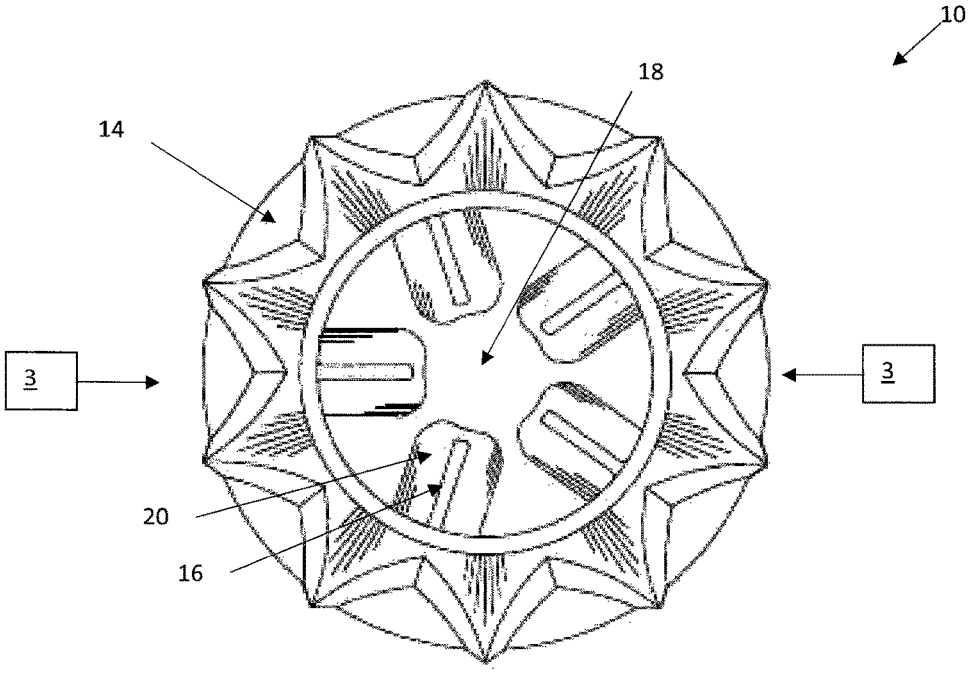
FIG. 2 is a top view of the device illustrated in FIG. 1.

According to a particularly preferred embodiment, a shoe heel support device 10 is provided. Referring to the drawings, the embodiment of the shoe heel support device 10 shown has a unitary configuration.

The shoe heel support 10 illustrated in the figures includes a ground contacting base 12 and a resilient shoe heel engagement portion 14. The resilient shoe heel engagement portion 14 of the illustrated embodiment includes five equidistant ribs, shown generally as ribs 16, which together define a bore 18 for receiving a shoe heel (not shown) therein in an interference fit.

As illustrated in the Figures, the device 10 has a cup shape. The ground contacting base 12 provided on the lower side of the device 10 extends over the lower end of the bore 18 to close the bore 18 such that when a shoe heel (not shown) is located correctly within the bore 18 and weight is placed on the shoe, the shoe pad (not shown) at the lower end of the shoe's heel (not shown) abuts the surface at the lower end of the bore 18, with the weight of the shoe's heel being transferred to the ground contacting base 12.

The heel engagement portion 14 has a cushion portion in the bore 18 above the ground contacting base 12.

Figure 3:
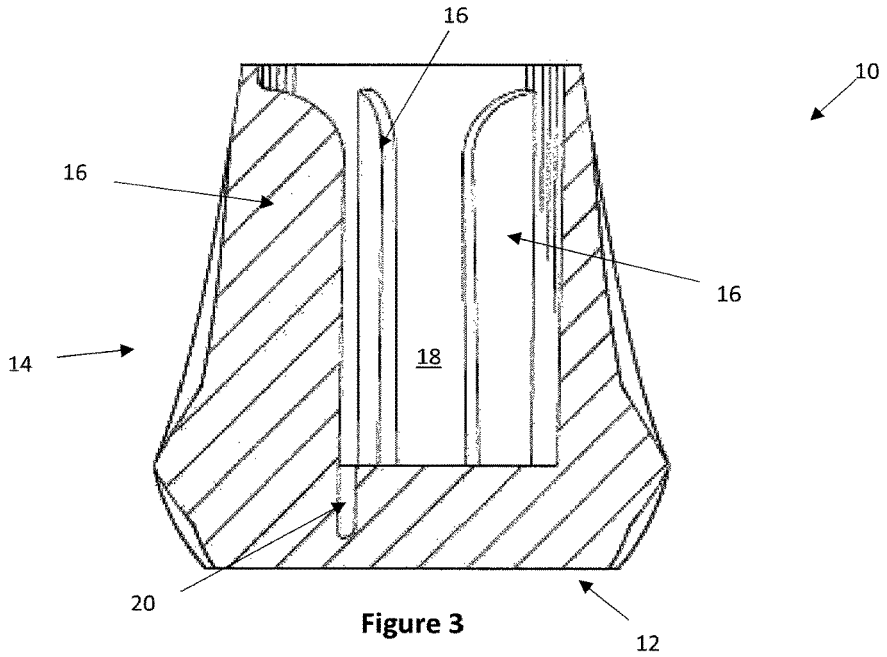
FIG. 3 is a sectional view of the inside of the device illustrated in FIG. 1 taken along the line 3-3 shown in FIG. 2.
Figure 4:
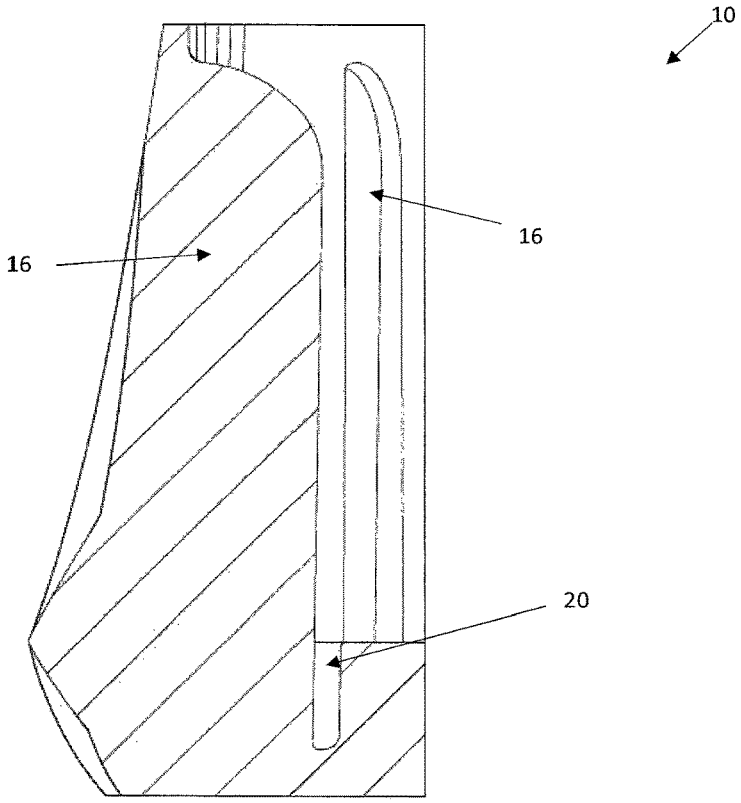
FIG. 4 is a more detailed sectional view of the inside of the device illustrated in FIG. 3.
Figure 5:
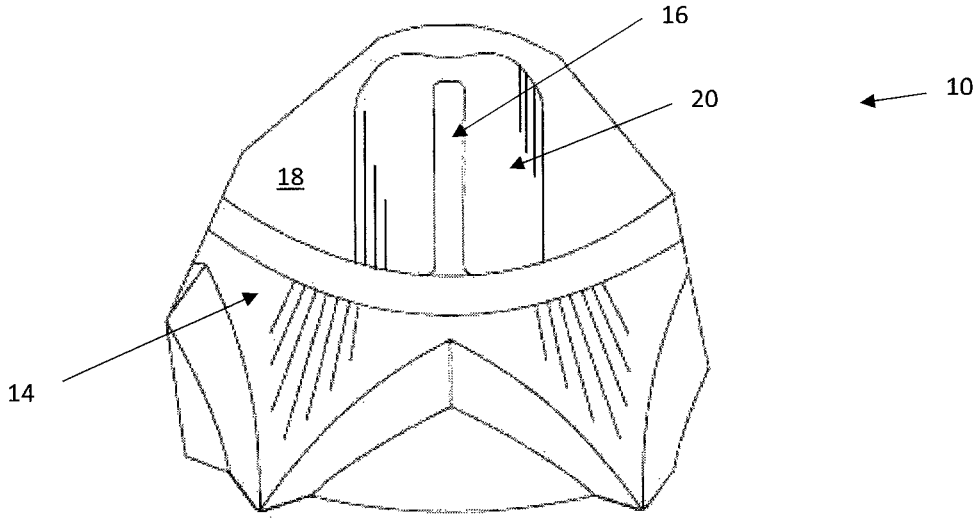
FIG. 5 is a detailed sectional view of the internal base demonstrating furrows of the device illustrated in FIG. 1.
Figure 6:
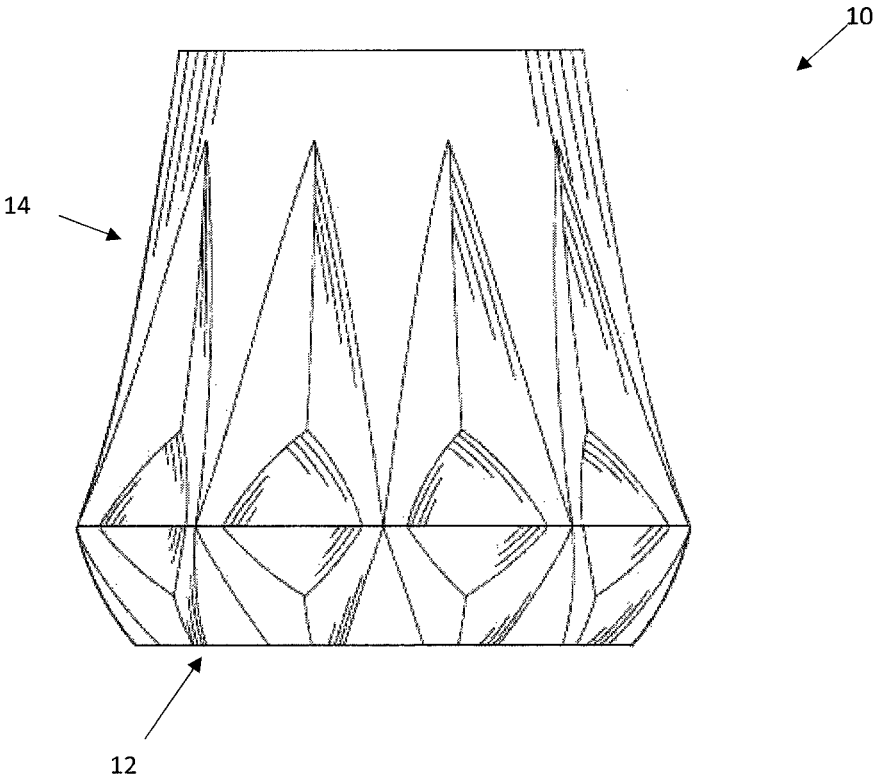
FIG. 6 is a side view of the device illustrated in FIG. 1.

The ground-contacting base 12 is larger in cross-sectional dimension than the shoe heel (not shown) in order to spread the load and to support the heel. As illustrated in FIGS. 3-5, the base portion of the bore 18 is a substantially circular plate member with five furrows or channels, shown generally as furrows 20, from which each of the ribs 16 emerge.

The furrows 20 allow the ribs 16 to deform outwardly from the entry of the bore 18 (i.e. at the top of the device 10), along their entire length, including within the furrows 20 at the base of the ribs 16 in order to allow passage of the heel, and also grip the heel once inserted.

FIGS. 3 and 4 show the resilient equidistant ribs 16 protruding upwardly from the base portion of the bore 18. These ribs 16 extend substantially from the top of the device 10 to the furrows 20 within the ground-contacting portion 12 of the device 10, with the rib 16 projection at the entry of the bore 18 being greater than the rib projection within the furrows 20 at the base of the device 10.

The heel engagement portion 14 of the illustrated embodiments is a unitary member. Both the ground contacting base 12 and the heel engagement portion 14 is manufactured from a resilient material. As such, the configuration of the heel engagement portion 14 is biased inwardly to grip the heel once the heel is inserted into the bore.

Adjusting the projection of the ribs 16 will typically adjust the degree of heel engagement and thereby increase surface friction with a shoe heel (not shown) and reduce the relative size of the bore 18.

According to the illustrated embodiment, the device 10 resembles a faceted gemstone when viewed from the side.

The bore 18 of the illustrated embodiment is substantially circular but it may be shaped differently as shoe heels are typically D-shaped in cross-section. Depending upon the embodiment, the bore 18 may have a continuous sidewall extending from the upper portion of the device to the ground-contacting base 12.

The bore 18 and its associated rib like projections 16 has a larger dimension in a region adjacent to the ground contacting base 12 and a smaller dimension at an upper region to create the interference fit. In this manner, the upper region will act to grip the shoe heel whilst the larger dimension lower down allows clearance for the heel pad of the shoe (which is typically slightly larger than the shoe heel itself).

The ground contacting base 12 acts as a bolster which when mounted on the heel (not shown) bolsters a substantial portion of the heel above ground level by inhibiting penetration of an upper portion of the heel into relatively soft ground. The bolster in use, is mounted to the heel at a selected distance from a base of the heel so as to facilitate a normal walking gait for a wearer (not shown) when walking on relatively hard ground.

The invention claimed is:

1. A unitary shoe heel accessory comprising:

a base portion comprising a ground contacting surface and an opposing heel pad contacting surface; and a resilient shoe heel engaging portion which extends upwardly from the base portion and comprises a circumferential sidewall that defines a bore therein, wherein inner surfaces of the side walls comprise a plurality of equispaced resilient ribs projecting therefrom, the resilient ribs configured for receiving and retaining a shoe heel within the bore, wherein the heel pad contacting surface is centrally located at a base of the bore and wherein the base portion further comprises a plurality of furrows equispaced around the heel pad contacting surface whereby each of the resilient ribs extends upwardly from a floor of a respective furrow, and wherein each furrow is deep enough such that a lowermost shoe heel contacting portion of each resilient rib is deflectable by a shoe heel within the bore.

2. The unitary shoe heel accessory of claim 1, wherein a lower edge of each resilient rib is affixed to the floor of each furrow.

3. The unitary shoe heel accessory of claim 1, wherein a width of each furrow is such that the deflectability of a lowermost shoe heel contacting portion of each resilient rib is limited.

4. The unitary shoe heel accessory of claim 1, wherein each resilient rib extends from each furrow to an uppermost edge of the resilient shoe heel engaging portion.

5. The unitary shoe heel accessory of claim 1, wherein each resilient rib tapers inwardly towards the other resilient ribs as it extends away from each furrow.

6. The unitary shoe heel accessory of claim 1, wherein an uppermost edge of each resilient rib is curved to define a shoe heel entry guide.

7. The unitary shoe heel accessory of claim 1, wherein an outer surface of the resilient shoe heel engaging portion extends inwardly as it extends upwardly from the base portion.

8. The unitary shoe heel accessory of claim 1, wherein an outer surface of the base portion extends inwardly as it extends downwardly from the resilient shoe heel engaging portion.

9. The unitary shoe heel accessory of claim 1, further comprising a cushion portion located on the heel pad contacting surface at the base of the bore.

10. The unitary shoe heel accessory of claim 1, wherein the base portion is circular.

11. The unitary shoe heel accessory of claim 1, comprising five equispaced resilient ribs on the inner surface of the circumferential sidewall of the resilient shoe heel engaging portion and five corresponding furrows in the base portion and equispaced around the heel pad contacting surface at the base of the bore.

* * * * *